United States Patent [19]

Takashima

[11] Patent Number: 4,961,371

[45] Date of Patent: Oct. 9, 1990

[54] HYDRAULIC CIRCUIT FOR A BACKHOE

[75] Inventor: Akira Takashima, Sakai, Japan

[73] Assignee: Kubota, Ltd., Osaka, Japan

[21] Appl. No.: 267,607

[22] Filed: Nov. 7, 1988

[30] Foreign Application Priority Data

Nov. 10, 1987 [JP] Japan ..... 62-172150[U]

[51] Int. Cl.[5] ..... E02F 3/32; F15B 13/09

[52] U.S. Cl. ..... 91/530; 414/687

[58] Field of Search ..... 60/420, 424, 484; 91/522, 525–526, 530, 531; 414/687

[56] References Cited

U.S. PATENT DOCUMENTS

| | | | |
|---|---|---|---|
| 4,171,054 | 10/1979 | Tanaka et al. | 91/525 X |
| 4,207,740 | 6/1980 | Ripa | 91/530 X |
| 4,528,892 | 7/1985 | Okabe et al. | 91/531 X |
| 4,561,341 | 12/1985 | Aikawa | 91/6 |
| 4,561,824 | 12/1985 | Okabe et al. | 91/530 X |
| 4,614,475 | 9/1986 | Tamura et al. | 91/530 X |

FOREIGN PATENT DOCUMENTS

| | | | |
|---|---|---|---|
| 1059406 | 7/1979 | Canada | 91/530 |
| 10801 | 2/1981 | Japan | 91/530 |

*Primary Examiner*—Carl D. Price
*Assistant Examiner*—George Kapsalas
*Attorney, Agent, or Firm*—Jordan and Hamburg

[57] ABSTRACT

A hydraulic circuit for a backhoe comprising a first multiple valve, a second multiple valve, and a confluence mechanism mounted between the first and second multiple valves. The first multiple valve includes control valves connected to a first pump in parallel to one another for driving working implements. The second multiple valve includes further control valves connected to a second pump in parallel to one another for driving other working implements. The confluence mechanism is connected to a rear end of a center bypass line of the first multiple valve and to a rear end of a center bypass line of the second multiple valve. Further, the confluence mechanism, in neutral position, is connected to a return oil line for confluently returning oil from the first and second multiple valves to a tank.

5 Claims, 3 Drawing Sheets

HYDRAULIC CIRCUIT FOR A BACKHOE

BACKGROUND OF THE INVENTION

The present invention relates to a hydraulic circuit for a backhoe, and more particularly to a hydraulic circuit comprising a first parallel type multiple valve including control valves connected to a first pump in parallel to one another for driving part of a plurality of working implements, a second parallel type multiple valve including further control valves connected to a second pump in parallel to one another for driving remaining working implements, and a confluence mechanism for combining a hydraulic pressure from the first pump and a hydraulic pressure from the second pump for delivery to an attachment control valve, FIG. 3 shows such a hydraulic circuit known in the art. This circuit comprises a first multiple valve A and a second multiple valve B formed separately, and a confluence mechanism C. The confluence mechanism C includes an attachment control valve V7 connected in parallel to the first multiple valve A and having a third center bypass line R3 connected to a rear end of a first center bypass line R1, and a confluence block 7 mounted in the first multiple valve A for connecting a rear end of a second center bypass line R2 of the second multiple valve B to a rear end of a parallel circuit 10 of the first multiple valve A.

When assembling the control valves into the backhoe, however, this construction requires a troublesome operation of assembling the first and second multiple valves A and B separately. Furthermore, the first multiple valve A must have a considerable length since oil cannot be supplied from the second multiple valve B to the attachment control valve V7 unless the confluence block 7 is mounted in the first multiple valve A. As a result, these valves on the whole require a large accommodating space.

SUMMARY OF THE INVENTION

The object of the present invention is to provide an improvment for reducing the space required for the control valves and facilitating assembly thereof.

In order to achieve this object, a hydraulic circuit for a backhoe according to the present invention is characterized in that the attachment control valve is mounted between and rigidly connected in parallel to the first and second multiple valves, the attachment control valve including a third center bypass line connected at one end thereof to a rear end of a first center bypass line of the first multiple valve and at the other end to a rear end of a second center bypass line of the second multiple valve, and a return oil line which, in neutral position, connects the third center bypass line to a confluent return oil line for confluently returning oil from the first and second multiple valves to a tank.

With the above construction, pressure oil is supplied directly from the first and second pumps to the attachment control valve through the bypass lines of the first and second multiple valves. In neutral position, pressure oil flowing from the first pump through the first center bypass line of the first multiple valve and pressure oil flow from the second pump through the second center bypass line of the second multiple valve join together in the third center bypass line of the attachment control valve for delivery to the confluence return oil line.

The pressure oil from the first and second pumps is thus supplied confluently to the attachment control valve without the confluence block mounted in the multilple valve as in the prior art. Consequently, the entire control valves are now assembled compactly into a small space. Further, since the first and second multiple valves are rigidly interconnected by the attachment control valve mounted therebetween, the entire control valves may be assembled into the backhoe in one operation. This feature has the effect of reducing manufacturing cost.

Other advantages of the present invention will be apparent from the following description.

BRIEF DESCRIPTION OF THE DRAWINGS

The drawings illustrate a hydraulic circuit for a backhoe embodying the present invention, in which.

DETAILED DESCRIPTION OF THE PREFERRED EMBODIMENT

An embodiment of the present invention will be described hereinafter with reference to the drawings.

Figure 1:
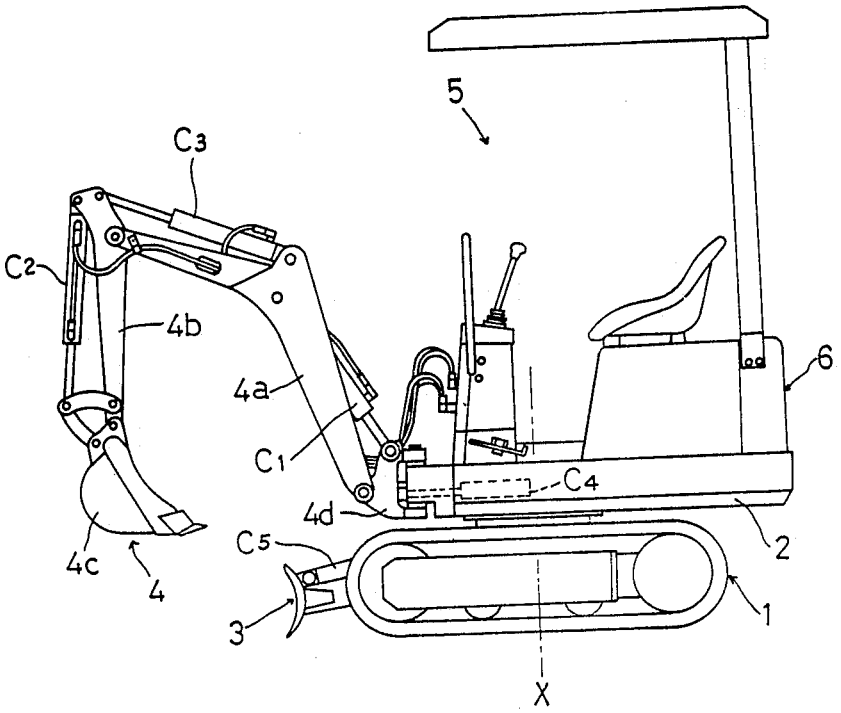
FIG. 1 is a side elevation of the backhoe.

Referring to FIG. 1, a small backhoe vehicle comprises a crawler running device 1, a swivel deck 2 mounted on the crawler running device 1, and a bulldozer blade 3 attached to the crawler running device 1. The swivel deck 2 carries a backhoe implement 4, a driver's section 5, and a motor section 6. Thus the backhoe vehicle is capable of earthmoving operations also.

The backhoe implement 4 includes a swing bracket 4*d* attached to the swivel deck 2 for sideways swinging movements, a boom 4*a* attached to the swing bracket 4*d* for vertical pivotal movements, an arm 4*b* attached to the boom 4*a* for fore and aft pivotal movements, and a bucket 4*c* attached to a distal end of the arm 4*b*. These components of the backhoe implement 4 are driven by hydraulic cylinders C1–C4.

Figure 2:
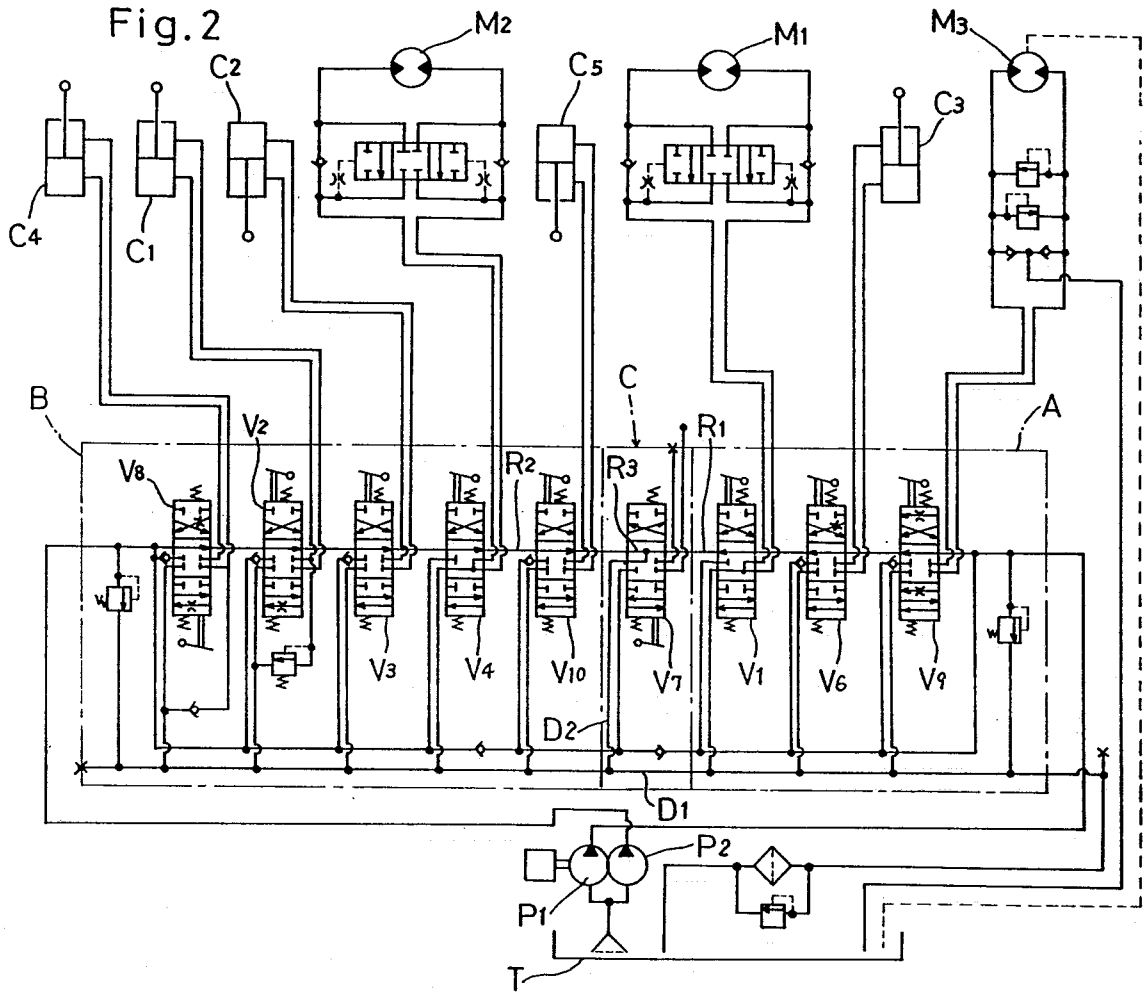
FIG. 2 is a diagram of the entire hydraulic circuit.
Figure 3:
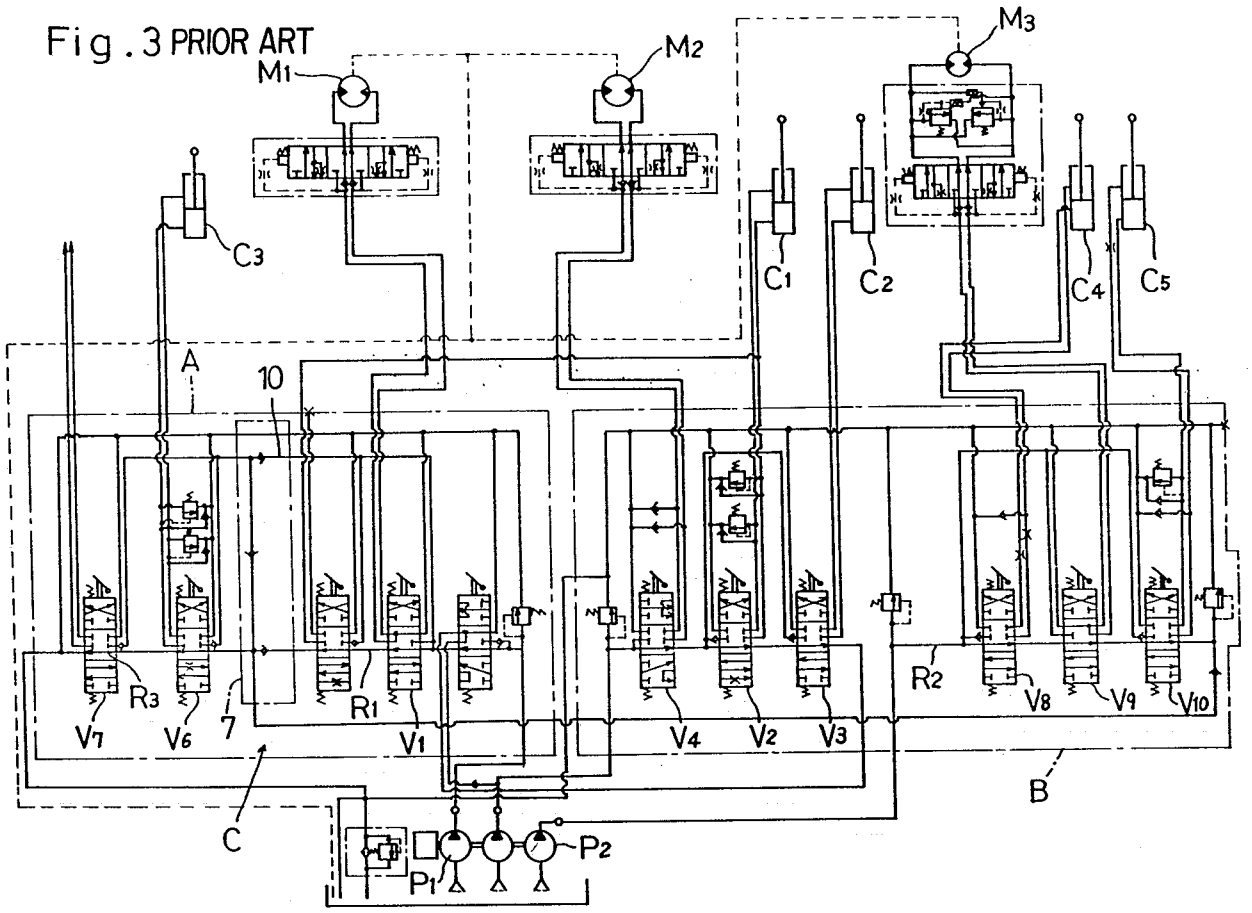
Fig. 3 PRIOR ART
FIG. 3 is an entire hydraulic circuit according to the prior art.

FIG. 2 shows a hydraulic circuit for driving the running device 1, swivel deck 2, bulldozer blade 3 and backhoe implement 4. This hydraulic circuit will be described in detail hereinafter.

The hydraulic circuit includes a first pump P1 and a second pump P2 operatively connected to an engine in the motor section 6. A first multiple valve A is formed which includes a control valve V9 connected to a swivel motor M3 for swiveling the swivel deck 2 on a vertical axis X relative to the running device 1, a control valve V6 connected to a hydraulic cylinder C3 for driving the arm 4*b*, and a first running control valve V1 connected to a hydraulic motor M1 for driving a left-hand crawler of the running device 1. These valves V9, V6 and V1 are arranged in the stated order, and connected to the first pump P1 in parallel to one another. A second multiple valve B is formed which includes a control valve V8 connected to a hydraulic cylinder C4 for driving the swing bracket 4*d*, a control valve V2 connected to a hydraulic cylinder C1 for driving the boom 4*a*, a control valve V3 connected to a hydraulic cylinder C2 for driving the buckey 4*c*, a second running control valve V4 connected to a hydraulic motor M2 for driving a righthand crawler of the running device 1, and a control valve V10 connected to a hydraulic cylinder C5 for driving the bulldozer blade 3. These valves V8, V2, V3, V4 and V10 are arranged in the stated order, and connected to the second pump P2 in parallel to one another. The first and second multiple valves A and B are rigidly interconnected in parallel by an attachment control valve V7 mounted therebetween. The attachment control valve V7 includes a third center bypass line R3 connected at one end thereof to a rear end of a first center bypass line R1 of the first multiple valve A and at the other end to a rear end of a second center bypass line R2 of the second multiple valve B. The attachment control valve V7 further includes a return oil line D2 which, in neutral position, is connected to a confluence return oil line D1 for confluently returning oil from the first and second multiple valves A and B to a tank T. Thus a confluence mechanism C is provided for supplying oil from the first pump P1 and oil from the second pump P2 confluently to the attachment control valve V7.

The control valves constituting the first and second multiple valves A and B may be grouped otherwise than in the described embodiment.

What is claimed is:

1. A hydraulic circuit comprising:

a first parallel type multiple valve including control valves connected to a first pump in parallel to one another for driving a part of a plurality of working implements;

a second parallel type multiple valve including further control valves connected to a second pump in parallel to one another for driving remaining working implements; and a confluence mechanism for combining a hydraulic pressure from the first pump and a hydraulic pressure from the second pump for delivery to an attachment control valve, wherein said attachment control valve is mounted between and integrally connected in parallel to said first and second multiple valves, said attachment control valve including a third center bypass line connected at one end thereof to a rear end of a first center bypass line of said first multiple valve and at the other end to a rear end of a second center bypass line of said second multiple valve, and a return oil line which, in neutral position, connects said third center bypass line to a confluent return oil line for confluently returning oil from said first and second multiple valves to a tank.

2. A hydraulic circuit as claimed in claim 1, wherein said first multiple valve includes a control valve connected to a swivel motor for swiveling a swivel deck, a control valve connected to a hydraulic cylinder for driving an arm, and a first running control valve connected to a hydraulic motor for driving a first crawler of a running device, and said second multiple valve includes a control valve connected to a hydraulic cylinder for driving a swing bracket, a control valve connected to a hydraulic cylinder for driving the boom, a control valve connected to a hydraulic cylinder for driving a bucket, a second running control valve connected to a hydraulic motor for driving a second crawler of the running device, and a control valve connected to a hydraulic cylinder for driving a bulldozer blade.

3. A hydraulic circuit for a backhoe comprising:

a first multiple valve including a plurality of control valves connected in parallel to one another, each said control valve being a three-position valve having a bypass line at a neutral position thereof, the bypass lines of said control valves together forming a first center bypass line;

a second multiple valve including a plurality of further control valves connected in parallel to one another, each said further control valve being a three-positon valve having a bypass line at a neutral position thereof, the bypass lines of said control valves together forming a second center bypass line;

an attachment control valve constructed as a three-position valve, said attachment control valve including a third center bypass line having, at a neutral position thereof, a pair of opposing inlet openings connected to a return port of said attachment control valve;

a confluent feed oil line including, at opposed ends thereof, a first pump mainly for said first multiple valve and a second pump mainly for said second multiple valve so as to receive oil from said pumps;

a plurality of branch feed oil lines for connecting said confluent feed oil line to pressure ports of said control valves and said attachment control valves;

a confluent return oil line connected to return ports of said control valves and said attachment control valve for returning oil therefrom to a tank;

said first and second center bypass lines being linearly aligned with each other to be connected to said inlet openings of said third center bypass line;

said first and second center bypass lines being connected to said confluent feed oil line at the sides of said first and second pumps relative to said first and second multiple valves, so that said first and second center bypass lines receive oil from said pumps in opposing directions; and said first multiple valve, said attachment control valve and said second multiple valve being connected hydraulically parallel to and integrally with one another in the aforementioned order.

4. A hydraulic circuit as claimed in claim 3, wherein said control valves of the first multiple valve comprise a control valve connected to a swivel motor for swivelling a swivel deck, a control valve connected to a hydraulic cylinder for driving an arm, and a first running control valve connected to a hydraulic motor for driving a first crawler of a running device, with said control valves of the first multiple valve being connected to each other in the aforementioned order, and said control valves of the second multiple valve comprise a control valve connected to a hydraulic cylinder for driving a swing bracket, a control valve connected to a hydraulic cylinder for driving a boom, a control valve connected to a hydraulic cylinder for driving a bucket, a second running control valve connected to a hydraulic motor for driving a second crawler of the running device, and a control valve connected to a hydraulic cylinder for driving a bulldozer blade, with said control valves of the second multiple valves being connected to each other in the aforementioned order.

5. A hydraulic circuit as claimed in claim 4, wherein said confluent feed oil line includes two check valves with one being disposed at a connecting position between said attachment control valve and said first running control valve, with the other being disposed at a connecting position between said bulldozer blade control valve and said second running control valve, said check valves checking reverse flows of confluence of opposing oil flows.

* * * * *